US005266114A

United States Patent [19]

Iwasaki

[11] Patent Number: 5,266,114

[45] Date of Patent: Nov. 30, 1993

[54] APPARATUS FOR SUPPLYING GRAVURE COATING MATERIAL

[75] Inventor: Takashi Iwasaki, Ebina, Japan

[73] Assignee: Yasui Seiki Co., Ltd., Tokyo, Japan

[21] Appl. No.: 709,644

[22] Filed: Jun. 3, 1991

[30] Foreign Application Priority Data

Jun. 7, 1990 [JP] Japan ..... 2-149075

[51] Int. Cl.[5] ..... B05C 1/00

[52] U.S. Cl. ..... 118/212; 118/244; 118/261; 101/366

[58] Field of Search ..... 118/46, 212, 241, 261, 118/410, 244; 101/366

[56] References Cited

U.S. PATENT DOCUMENTS

| | | | |
|---|---|---|---|
| 2,641,220 | 6/1953 | Weber et al. | 118/261 |
| 2,689,545 | 9/1954 | Nelson | 118/261 |
| 2,787,244 | 4/1957 | Hickin | 118/212 |
| 3,294,060 | 12/1966 | McIntyre et al. | 118/261 |
| 3,298,305 | 1/1967 | Noon | 101/366 |
| 3,991,708 | 11/1976 | Huebschmann et al. | 118/212 |
| 3,993,020 | 11/1976 | Schneider et al. | 101/366 |
| 4,316,428 | 2/1982 | Flaum et al. | 118/261 |
| 4,548,840 | 10/1985 | States et al. | 118/261 |
| 4,625,643 | 12/1986 | Davis | 101/366 |

FOREIGN PATENT DOCUMENTS

| | | | |
|---|---|---|---|
| 3700569 | 8/1988 | Fed. Rep. of Germany | 118/261 |
| 2174625 | 11/1986 | United Kingdom | 118/261 |
| 2204255 | 11/1988 | United Kingdom | 118/261 |

*Primary Examiner*—W. Gary Jones
*Assistant Examiner*—Todd J. Burns

[57] ABSTRACT

An apparatus for supplying gravure coating material in which coating material is directly supplied to a contacting portion of a doctor blade and a gravure roll. The apparatus includes a gravure roll, a doctor blade, supporting means for supporting the doctor blade in such a manner that contacting state of the doctor blade relative to the gravure roll is adjustable, a coating material primary reservoir for temporarily reserving coating material, measuring means for measuring and controlling the quantity of coating material fed from said coating material primary reservoir, and a coating material secondary reservoir for supplying coating material through the measuring means to a contacting portion of the doctor blade and the gravure roll.

5 Claims, 2 Drawing Sheets

APPARATUS FOR SUPPLYING GRAVURE COATING MATERIAL

BACKGROUND OF THE INVENTION

The present invention relates to an apparatus for supplying gravure coating material, and more particular to an apparatus for supplying gravure coating material in which a fixed quantity of coating material can be supplied to a gravure roll and coating material can be uniformly coated onto a running substrate.

According to a conventional gravure coating device, a lower portion of a gravure roll is soaked in coating material accommodated in a pan-shaped coating material reservoir having an open upper side, and then the gravure roll is rotated, thereby supplying coating material to cells (engraved portions) formed on the outer periphery of the gravure roll and rolling up the coating material. In the meantime, surplus coating material is scraped off from the outer periphery of the gravure roll by a doctor blade, a fixed quantity of coating material filled in the cells (engraved portions) is supplied to a contacting portion of a continuous substrate such as a thin film or a web and the gravure roll, thereafter the coating material is transferred to the substrate and coating is performed.

However, in the conventional gravure coating device, since coating material is supplied to the coating material reservoir more than coating material is coated on the continuous substrate by the gravure roll, coating material always overflows the coating material reservoir. Therefore, it is necessary to install a mechanism for collecting overflowed coating material and recirculating the same, and it is troublesome to clean the mechanism and the pan-shaped coating material reservoir when replacing the gravure roll.

Further, since coating material is recirculated, it is oxidized or deteriorated by absorbing water during recirculation. As a result, the color of recirculated coating material is different from that of coating material already coated, thereby causing uneven coloration of coated portions. Furthermore, minute bubbles are mixed in coating material during recirculation, thus causing poor coating.

In another aspect, according to the conventional gravure coating device, it is difficult to roll up coating material having high viscosity such as magnetic ink by the gravure roll. Particularly, when rotating the gravure roll at high speed in order to perform high speed coating, coating material is not filled in the cells (engraved portions) formed on the outer periphery of the gravure roll, whereby coating cannot be performed frequently.

In order to eliminate such drawbacks, there has been another type of gravure coating device in which coating material is directly supplied into the cells (engraved portions) of the outer periphery of the gravure roll by a nozzle, and then surplus coating material is scraped off by the doctor blade.

However, since supply of coating material from the nozzle is limited to a small quantity, coating speed is limited to extremely low speed. Further, since coating material scraped off by the doctor blade is recirculated, this type of gravure coating device using the nozzle still has the same drawbacks as the former type of device mentioned above.

SUMMARY OF THE INVENTION

It is, therefore, an object of the present invention to overcome the above-mentioned prior art disadvantages and to provide an improved apparatus for supplying gravure coating material which can perform high speed coating and can easily and reliably coat using coating material having high viscosity, and which can coat without overflowing of coating material.

Another object of the present invention is to provide an apparatus for supplying gravure coating material which can supply the approximately same quantity of coating material as the transferred coating material onto the substrate, thereby obtaining coating of good quality, and which can lower manfacturing and operation costs.

The objects of the present invention are fulfilled by providing an apparatus for supplying gravure coating material comprising: a gravure roll for coating , coating material onto a running substrate; a doctor blade for scraping off surplus coating material, the doctor blade being brought in contact with an outer periphery of the gravure roll; supporting means for supporting the doctor blade in such a manner that contacting state of the doctor blade relative to the gravure roll is adjustable; a coating material primary reservoir for temporarily reserving coating material, the coating material primary reservoir being integrally formed on the supporting means; measuring means for measuring and controlling the quantity of coating material fed from the coating material primary reservoir; and a coating material secondary reservoir for supplying coating material through the measuring means to a contacting portion of the doctor blade and the gravure roll, the coating material secondary reservoir being integrally formed on the supporting means.

With the above structure of the present invention, the coating material primary reservoir and the coating material secondary reservoir are integrally formed on the doctor blade supporting means. Therefore, while the relation of the coating material secondary reservoir relative to the doctor blade is always positionally kept proper, contacting pressure of the doctor blade with respect to the gravure roll can be properly adjusted.

Further, coating material fed to the coating material primary reservoir is adjusted into a uniform flow rate in the longitudinal direction of the doctor blade while passing through the measuring means and is supplied to the coating material secondary reservoir. Thereafter, coating material is directly supplied to the contacting portion of the doctor blade and the gravure roll from the coating material secondary reservoir, surplus coating material is scraped off into the coating material secondary reservoir by the doctor blade and a fixed quantity of coating material is measured and supplied into the cells or engraved portions of the gravure roll, and then coating material on the gravure roll is transferred to the continuous substrate to thus perform coating. That is, coating material is directly supplied tot he gravure roll from the coating material secondary reservoir, and coating material is measured exactly by the doctor blade, so that high speed coating can be performed and coating material having high viscosity can be coated reliably. Further, coating material can be effectively utilized without overflowing of coating material and can be coated on the continuous substrate in such a manner that the amount of coating material supplied to the coating material primary reservoir is approximately equal to that of coating material taken out of the coating material secondary reservoir by the gravure roll. Therefore, coating of high quality can be performed by supplying a small amount of coating material.

The above and other objects, features and advantages of the present invention will become more apparent from the following description when taken in conjunction with the accompanying drawings in which preferred embodiments of the present invention are shown by way of illustrative examples.

DETAILED DESCRIPTION OF THE PREFERRED EMBODIMENT

An embodiment of an apparatus for supplying gravure coating material of the present invention will be described below with reference to FIGS. 1 through 6.

Figure 1:
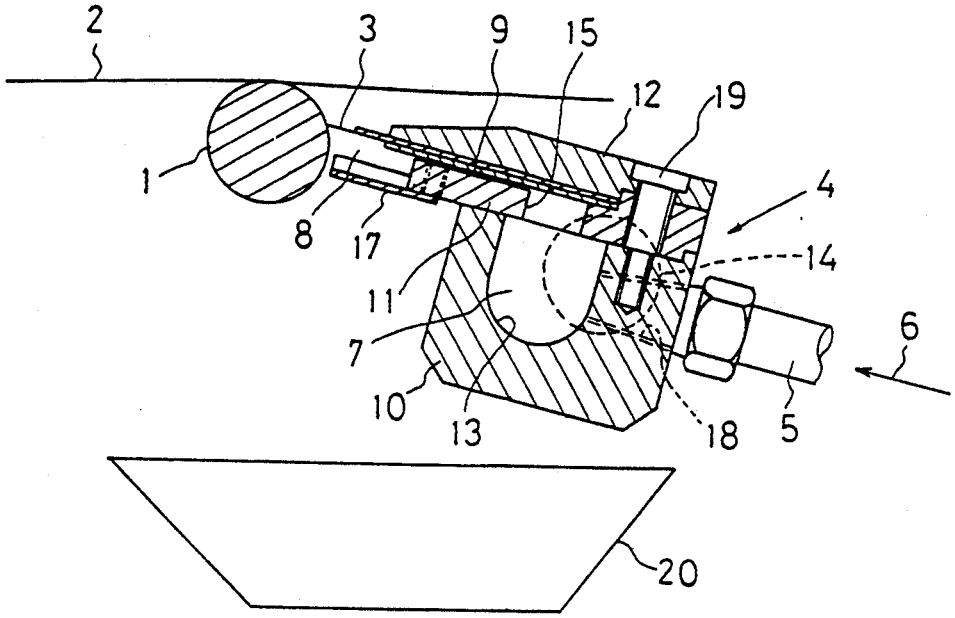
FIG. 1 is a vertical cross-sectional view showing an apparatus for supplying gravure coating material according to an embodiment of the present invention.
Figure 2:
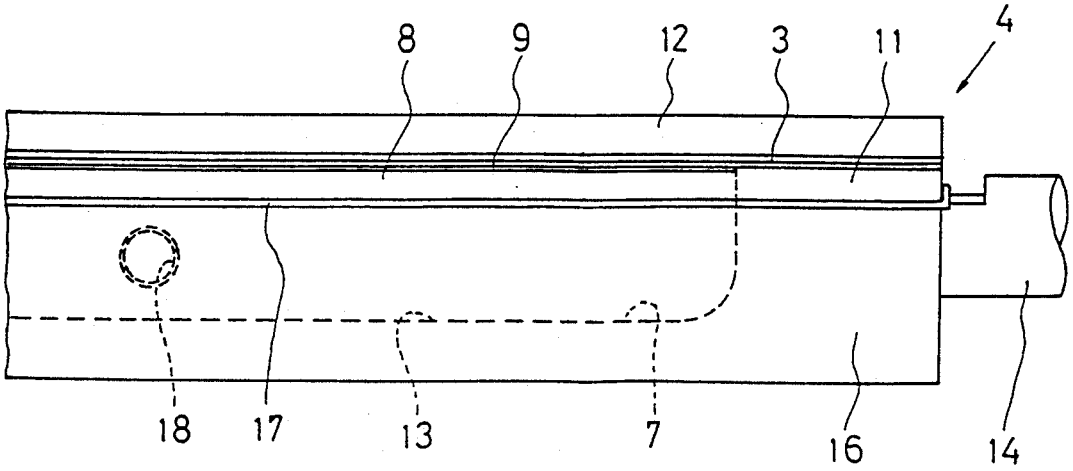
FIG. 2 is partially left side view of FIG. 1.

As shown in FIG. 1 this embodiment shows an example in which coating is applied to a continuous substrate 2 using a gravure roll 1 having a relatively small diameter of 20 mm to 50 mm.

A doctor blade 3 which is brought in contact with an outer peripheral surface of the gravure roll 1 is supported by a blade supporting assembly 4. The blade supporting assembly 4 is integrally provided with a coating material primary reservoir 7 for temporarily reserving coating material 6 fed from outside through a feeding passage 5 and a coating material secondary reservoir 8 for directly supplying the coating material 6 to a contact portion of the doctor blade 3 and the gravure roll 1. Further, the blade supporting assembly 4 is integrally provided with a measuring passage 9 for measuring the coating material 6 from the coating material primary reservoir 7 and supplying the same to the coating material secondary reservoir 8 so as to make the coating material 6 uniform in a longitudinal direction of the doctor blade 3.

Figure 3:
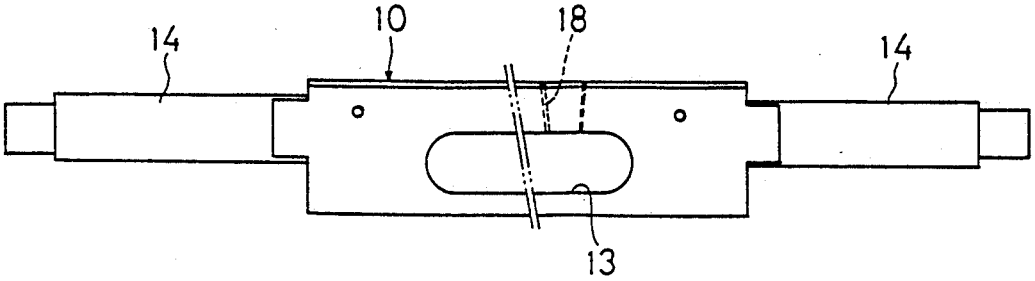
FIG. 3 is a plan view showing a base member in a blade supporting assembly used in the apparatus for supplying gravure coating material according to the embodiment of the present invention.
Figure 4:
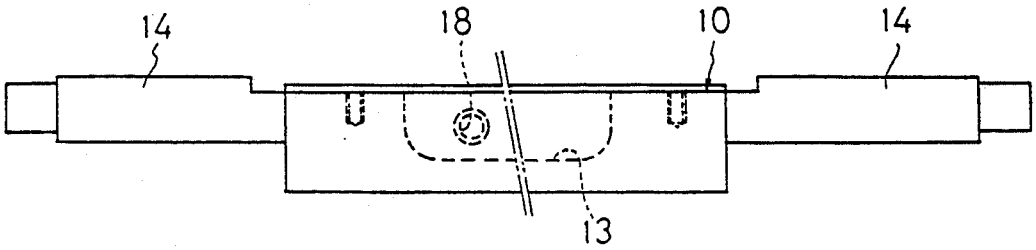
FIG. 4 is a front view showing the base member in the blade supporting assembly used in the apparatus for supplying gravure coating material according to the embodiment of the present invention.
Figure 5:
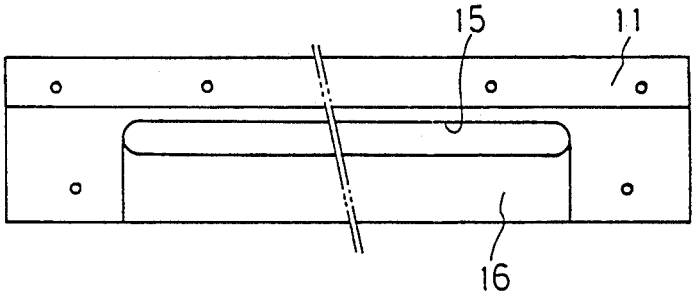
FIG. 5 is a plan view showing a spacer in the blade supporting assembly used in the apparatus for supplying gravure coating material according to the embodiment of the present invention.
Figure 6:
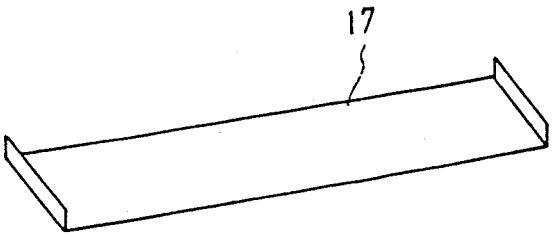
FIG. 6 is a perspective view showing a plate in the blade supporting assembly used in the apparatus for supplying gravure coating material according to the embodiment of the present invention.

To be more specific, the blade supporting assembly 4 supports the doctor blade 3 and adjusts a contacting pressure of the doctor blade 3 with respect to the gravure roll 1 to make it a proper value, so that the blade supporting assembly 4 comprises a base member 10, a spacer 11 and a blade presser 12 which are orderly arranged in a vertical direction. The base member 10 is formed with a U-shaped groove 13 in a longitudinal direction so as to form the coating material primary reservoir 7 having the same width as coating area of the continuous substrate 2 as shown in FIGS. 3 and 4. The base member 10 has, at both side ends thereof, supporting shafts 14, 14 which project therefrom and support the overall base member 10. The spacer 11 is disposed on the flat upper portion of the base member 10 so that the doctor blade 3 is sandwiched and supported between the spacer 11 and the blade presser 12. The spacer 11 is formed, at its central portion, with a through hole 15 which is communicated with the U-shaped groove 13 of the base member 10 and has the same length as the U-shaped groove 13 as shown in FIG. 5. The spacer 11 has a recess 16 on an upper side thereof and at the side of the gravure roll 1. The recess 16 functions as the measuring passage 9. As shown in FIG. 6 the spacer 11 also has a plate 17 fixed thereto by fastening members such as screws on a lower side thereof and at the side of gravure roll 1, so that the doctor blade 3, the spacer 11 and the plate 17 jointly define the coating material secondary reservoir 8 for directly supplying the coating material 6 into the contacting portion of the gravure roll 1 and the doctor blade 3. The base member 10 is formed with a connecting hole 18 communicated with the U-shaped groove 13. A plug socket constituting the feeding passage 5 is inserted into the connecting hole 18. The doctor blade 3, the base member 10, the spacer 11 and the blade presser 12 are assembled integrally by assembling bolts 19.

In this embodiment, a coating material receiver 20 is preferably provided under the gravure roll 1 and the apparatus for supplying gravure coating material so that drops of coating material can be received by the coating material receiver 20 in case of replacing the gravure roll 1 or the coating material 6.

Next, operation of the apparatus for supplying gravure coating material thus constructed will be described below.

According to the apparatus for supplying gravure coating material of the present embodiment, the coating material primary reservoir 7 for supplying the coating material 6, the measuring passage 9 and the coating material secondary reservoir 8 are integrally provided in the blade supporting assembly 4 for supporting the doctor blade 3. Therefore, while the relation of the coating material secondary reservoir 8 relative to the doctor blade 3 is always kept proper, contacting pressure of the doctor blade 3 with respect to the gravure roll 1 can be properly adjusted by rotating the blade supporting assembly 4 around the supporting shaft 14.

In coating operation, the coating material 6 supplied to the coating material primary reservoir 7 through the feeding passage 5 is adjusted into a uniform flow rate in the longitudinal direction of the doctor blade 3 while passing through the measuring passage 9, and the coating material 6 is supplied to the coating material secondary reservoir 8. Thereafter the coating material 6 is directly supplied to the contacting portion of the doctor blade 3 and the gravure roll 1. At this time, the surplus coating material 6 is scraped off into the coating material secondary reservoir 8 by the doctor blade 3, and the proper quantity of the coating material 6 is measured and supplied to the cells or engraved portions of the gravure roll 1. In the meantime the coating material 6 is transferred from the gravure roll 1 to the continuous running substrate 2.

In this embodiment, since the coating material 6 is directly supplied to the gravure roll 1 from the coating material secondary reservoir 8 and is measured accurately by the doctor blade 3, high speed coating can be performed and coating material having high viscosity can be coated reliably. The amount of coating material 6 fed to the coating material primary reservoir 7 can be approximately equal to that of coating material 6 taken out of the coating material secondary reservoir 8 by the gravure roll 1, so that the coating material 6 can be effectively utilized to perform coating of the continuous substrate 2 without overflowing the coating material secondary reservoir 8. As a result, coating of good quality can be performed by supplying a small amount of coating material.

As is apparent from the above description, the apparatus for supplying gravure coating material in the embodiment has the same operation as that of closed type, that is, the apparatus can be operated in such a manner that the coating material 6 does not leak at all from the coating material secondary reservoir 8 and does not recirculate. Therefore, discoloration of the coating material 6 can be prevented during coating operation and uneven coloration can be also prevented, coating of good quality can be performed.

Further, in this embodiment, since the substrate 2 is brought into contact with the gravure roll 1 without holding the substrate 2 together with the backup roll, and a fixed quantity of the coating material 6 measured correctly through the doctor blade 3 is supplied to the gravure roll 1 having a small diameter such as about 20 mm to about 50 mm, even if the substrate 2 is thin, coating of good quality can be performed without developing longitudinal wrinkles. Coating having uniform thickness can be applied to the substrate 2 all over using only the gravure roll 1 without using a smoother.

Furthermore, in this embodiment, the coating material 6 can be flattened and thickness of coating can be freely adjusted using a simple structure, thereby lowering manufacturing and operation costs. Further, since the gravure roll 1 is a small diameter, the overall structure can become compact. The apparatus has the same structure as that of closed type without overflowing of the coating material 6, so that replacing work of gravure roll or cleaning work of coating material can be easily and quickly carried out when changing color of pinted matter.

In this embodiment the diameter of the gravure roll can be changed into a larger one, coating method can be also changed from Kiss impression method into any other method.

As is apparent from the above description, according to the present invention, it is possible to obtain high speed coating, and coating material of high viscosity can be easily and reliably coated. Further, coating can be performed without overflowing of coating material, and coating of good quality can be performed in such a manner that the quantity of coating material supplied to the coating material secondary reservoir is approximately equal to that of coating material transferred to the substrate. Furthermore, coating material or the gravure roll can be replaced easily, and manufacturing and operation costs can be lowered.

Although certain preferred embodiments have been shown and described, it should be understood that many changes and modifications may be made therein without departing from the scope of the appended claims.

What is claimed is:

1. An apparatus for supplying gravure coating material comprising:

a gravure roll for coating coating material onto a running substrate;

a doctor blade for scraping off surplus coating material, said doctor blade being brought in contact with an outer periphery of said gravure roll along a line of contact adjacent the running substrate;

supporting means for supporting said doctor blade in such a manner that the contacting state of said doctor blade relative to said gravure roll is adjustable, said supporting means having a base and a spacer positioned between said base and said doctor blade;

a coating material primary reservoir for temporarily reserving coating material, said coating material primary reservoir being integrally formed in said base of said supporting means;

measuring means in said spacer of said supporting means for measuring and controlling the quantity of coating material fed from said coating material primary reservoir; and a coating material secondary reservoir for supplying said quantity of coating material fed through said measuring means to said line of contact remote from the running substrate, said coating material secondary reservoir being integrally formed in said spacer of said supporting means, whereby said measuring means may be changed by changing said spacer.

2. The apparatus for supplying gravure coating material as recited in claim 1, wherein said measuring means comprises a passage in said spacer extending between said coating material primary reservoir and said coating material secondary reservoir, said spacer being mounted between said blade and said base with said passage confronting said blade.

3. The apparatus for supplying gravure coating material as recited in claim 1, wherein said measuring means is constructed to provide a flow rate of coating material whereby the quantity of coating material supplied to said coating material secondary reservoir is approximately equal to that of coating material transferred to said substrate from said gravure roll.

4. The apparatus for supplying gravure coating material as recited in claim 1, wherein said coating material secondary reservoir is provided in said spacer immediately adjacent said doctor blade so that coating material is directly supplied to said line of contact between said doctor blade and said gravure roll.

5. The apparatus for supplying gravure coating material as recited in claim 1, further comprising a coating material receiver provided under said gravure roll and said secondary reservoir to receive the surplus coating material.

* * * * *